US006434864B1

(12) United States Patent
Epshteyn

(10) Patent No.: US 6,434,864 B1
(45) Date of Patent: Aug. 20, 2002

(54) FRONTAL LOADER

(76) Inventor: Grigoriy Epshteyn, 4169 Parsons Blvd., New York, NY (US) 11355

( * ) Notice: Subject to any disclaimer, the term of this patent is extended or adjusted under 35 U.S.C. 154(b) by 0 days.

(21) Appl. No.: 09/667,466

(22) Filed: Sep. 22, 2000

(51) Int. Cl.[7] ..... E02F 3/34
(52) U.S. Cl. ..... 37/428; 37/902
(58) Field of Search ..... 37/411, 428, 902; 172/2, 3; 60/414, 415

(56) References Cited

U.S. PATENT DOCUMENTS

| | | | | |
|---|---|---|---|---|
| 4,191,017 A | | 3/1980 | Dezelan | 60/420 |
| 4,779,416 A | | 10/1988 | Chatterjea | 60/429 |
| 4,962,825 A | | 10/1990 | Albright et al. | 180/292 |
| 5,083,428 A | | 1/1992 | Kubomoto | 60/421 |
| 5,794,438 A | * | 8/1998 | Lisniansky | 60/327 |
| 6,170,261 B1 | * | 1/2001 | Ishizaki et al. | 60/421 |

* cited by examiner

*Primary Examiner*—Thomas B. Will
*Assistant Examiner*—Meredith C. Petravick
(74) *Attorney, Agent, or Firm*—Goldstein & Lavas, P.C.

(57) ABSTRACT

A front loader using smaller capacity engine, due to energy recuperation, while utilizing the same capacity and decreasing fuel consumption and toxic exhaust bulk. The front loader uses energy recuperation both when excavating material and upon movement with simultaneous lift of a loaded bucket. The front loader uses energy recuperation irrespective of the type of transmission to the loader wheels. The front loader uses a single crank control, without throttle control, hydraulic distributor of bucket turn, hydraulic distributor of boom lift, and displacement volume of variable pump-motor working equipment.

1 Claim, 3 Drawing Sheets

FRONTAL LOADER

BACKGROUND OF THE INVENTION

The present invention relates to a frontal loaders and more particularly pertains to providing increased efficiency while minimizing fuel consumption.

The use of frontal loaders is known in the prior art. More specifically, frontal loaders heretofore devised and utilized for the purpose of digging and excavating are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,779,416 to Chatterjea discloses a control system for the boom and bucket of a front end loader, comprised of an auxiliary pump and a primary pump. U.S. Pat. No. 4,962,825 to Albright discloses a skid steer loader with a hydraulic motor mounted to each side of the transmission case. U.S. Pat. No. 4,191,017 to Dezelan discloses a variable displacement drive motor and an auxiliary motor for use with a grader. U.S. Pat. No. 5,083,428 to Kubomoto discloses a fluid control system using two main pumps for use with a power shovel.

While these devices fulfill their respective, particular objective and requirements, the aforementioned patents do not describe a frontal loader for providing increased efficiency while minimizing fuel consumption.

In this respect, the frontal loader according to the present invention substantially departs from the conventional concepts and designs of the prior art, and in doing so provides an apparatus primarily developed for the purpose of providing increased efficiency while minimizing fuel consumption.

Therefore, it can be appreciated that there exists a continuing need for a new and improved frontal loader which can be used for providing increased efficiency while minimizing fuel consumption. In this regard, the present invention substantially fulfills this need.

SUMMARY OF THE INVENTION

In the view of the foregoing disadvantages inherent in the known types of frontal loaders now present in the prior art, the present invention provides an improved frontal loader. As such, the general purpose of the present invention, which will be described subsequently in greater detail, is to provide a new and improved frontal loader which has all the advantages of the prior art and none of the disadvantages.

To attain this, the present invention essentially comprises a front loader comprised of an engine, working equipment, a bucket and a corresponding hydraulic cylinder or bucket turn, a boom and a corresponding hydraulic cylinder or boom lift. The engine has a gear connected thereto. The gear has a first outlet shaft coupled thereto. The front loader includes a turbine transformer coupled with the first outlet shaft of the engine. The turbine transformer has an outlet shaft couplable to loader wheels by a gear box and driving axle. The gear has a pair of gear wheels coupled thereto. The gear has a second outlet shaft. The working equipment has a variable displacement pump-motor having a hydraulic servo. The displacement pump-motor has a shaft coupled with the second outlet shaft of the gear. The displacement pump-motor is coupled with hydraulic cylinders, or the boom lift via a first hydraulic line to a distributor of the boom lift. This distributor has an outlet. The outlet is coupled with the distributor or hydraulic cylinder of the bucket turn by a second hydraulic line. The second distributor has a discharge port coupled with a tank by a third hydraulic line. A suction line of the pump-motor has a check valve disposed therein. The distributor of the boom lift has control chambers for lifting and lowering. The distributor of the bucket turn has control chambers for excavating and unloading. The outlet for the distributor of the boom lift has supply lines and a check valve coupled with the hydraulic cylinders or boom lift. The outlet for the distributor of the bucket turn has supply lines and a check valve coupled with the hydraulic cylinder or bucket turn. A third hydraulic distributor is supplied with a pair of control chambers. The suction line of the pump motor is coupled with the third hydraulic distributor by a first hydraulic line. The third hydraulic distributor has second and third hydraulic lines. The second hydraulic line is coupled with a pneumohydraulic accumulator. The third hydraulic line is coupled by two check valves to the hydraulic cylinders or boom lift and the bucket turn. One of the control chambers of the third hydraulic distributor is connected to the excavating and lifting control chambers by separate hydraulic lines and a two-position valve and the first valve. The other control chamber of the third hydraulic distributor is connected with the unloading and lowering control chambers by separate lines and the second valve. A remote proportional control block with a control crank is coupled with the excavation control chamber by a pair of lines and with the unloading control chamber by a pair of lines and with the lowering control chamber by a pair of lines and with the lifting control chamber by a pair of lines and with the hydraulic servo by a first, second and third valves. The two-position valve has control hydraulic line coupled with the first hydraulic line.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved frontal loader which has all the advantages of the prior art frontal loaders and none of the disadvantages.

It is another object of the present invention to provide a new and improved frontal loader which may be easily and efficiently manufactured and marketed.

It is a further object of the present invention to provide a new and improved frontal loader which is of durable and reliable construction.

An even further object of the present invention is to provide a new and improved frontal loader which is susceptible of a low cost of manufacture with regard to both materials and labor, and which accordingly is then susceptible of low prices of sale to the consuming public, thereby making such a frontal loader economically available to the buying public.

Even still another object of the present invention is to provide a new and improved frontal loader for providing increased efficiency while minimizing fuel consumption.

Lastly, it is an object of the present invention to provide a new and improved frontal loader including a front loader comprised of an engine, working equipment, a bucket and a corresponding hydraulic cylinder or bucket turn, boom and a corresponding hydraulic cylinder or boom lift. The engine has a gear connected thereto. The gear has a first outlet shaft coupled thereto. The front loader includes a turbine transformer coupled with the first outlet shaft of the engine. The turbine transformer has an outlet shaft culpable to loader wheels by a gear box and driving axle. The gear has a pair of gear wheels coupled thereto. The gear has a second outlet shaft. The working equipment has a variable displacement pump-motor having a hydraulic servo. The variable displacement pump-motor has a shaft coupled with the second outlet shaft of the gear. The displacement pump-motor is coupled with hydraulic cylinders or the boom lift via a first hydraulic line and a distributor of the boom lift. This distributor has an outlet. The outlet is coupled with the distributor or hydraulic cylinder of the bucket turn by a second hydraulic line. The second distributor has a discharge port coupled with a tank by a third hydraulic line. A suction line of the pump motor has a check valve disposed therein. The distributor of the boom lift has control chambers for lifting and lowering. The distributor of the bucket turn has control chambers for excavating and unloading. The outlet for the distributor of the boom lift has supply lines and a check valve coupled with the hydraulic cylinder or boom lift. The outlet for the distributor of the bucket turn has supply lines and a check valve coupled with the hydraulic cylinder or the bucket turn. A third hydraulic distributor is supplied with a pair of control chambers. The suction line of the pump motor is coupled with the third hydraulic distributor by a first hydraulic line. The third hydraulic distributor has second and third hydraulic lines. The second hydraulic line is coupled with a pneumohydraulic accumulator. The third hydraulic line is coupled by two check valves to the hydraulic cylinders or boom lift and the bucket turn. One of the control chambers of the third hydraulic distributor is connected to the excavating and lifting control chambers by separate hydraulic lines and a two-position valve and the first valve. The other control chamber of the third hydraulic distributor is connected with the unloading and lowering control chambers by separate lines and the second valve. A remote proportional control block with a control crank is coupled with the excavation control chamber by a pair of lines and with the unloading control chamber by a pair of lines and with the lowering control chamber by a pair of lines and with the lifting control chamber by a pair of lines and with the hydraulic servo by a first, second and third valves. The two-position valve has control hydraulic line coupled with first hydraulic line.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
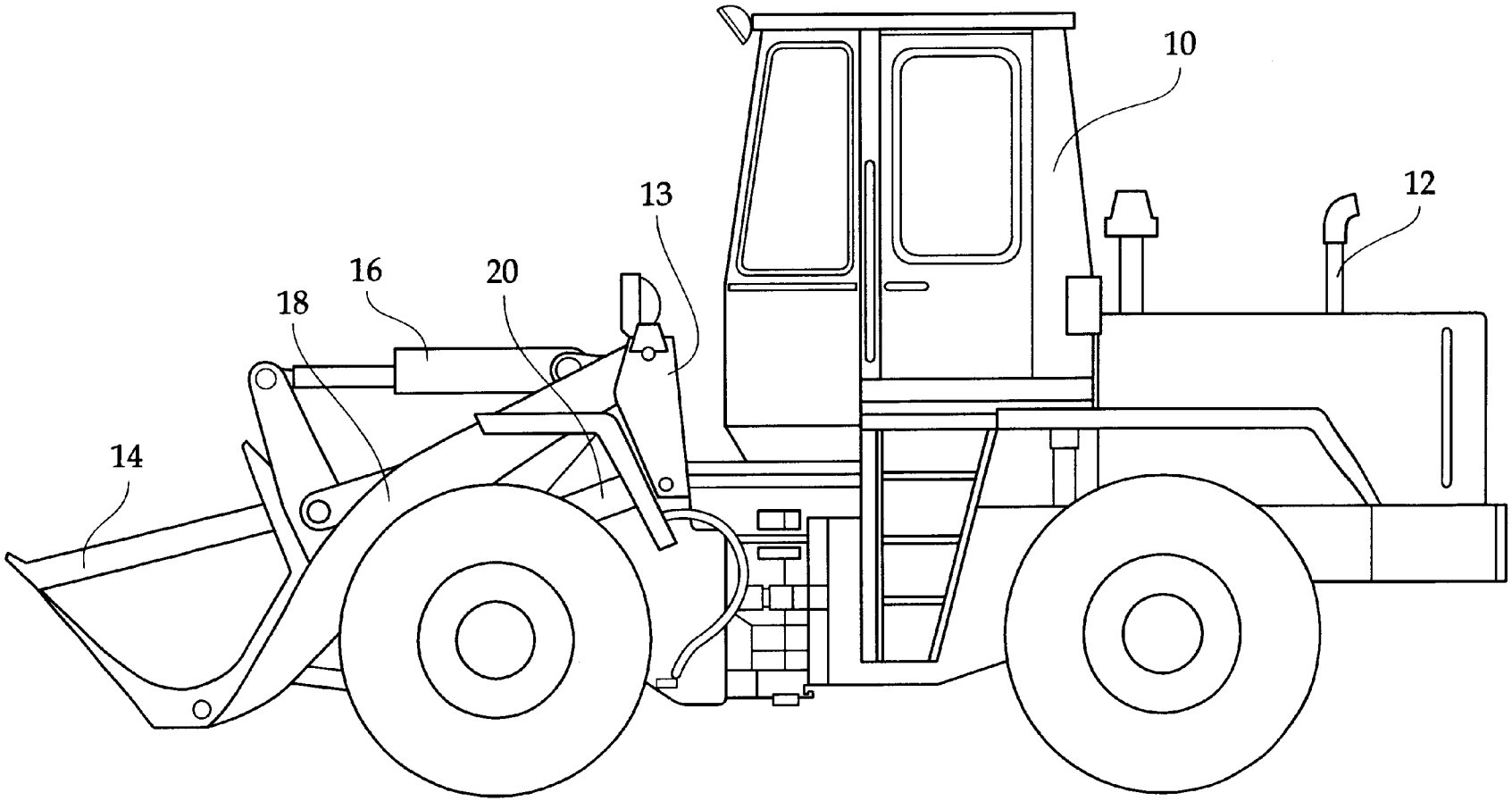
FIG. 1 is a perspective view of the preferred embodiment of the frontal loader constructed in accordance with the principles of the present invention.
Figure 2:
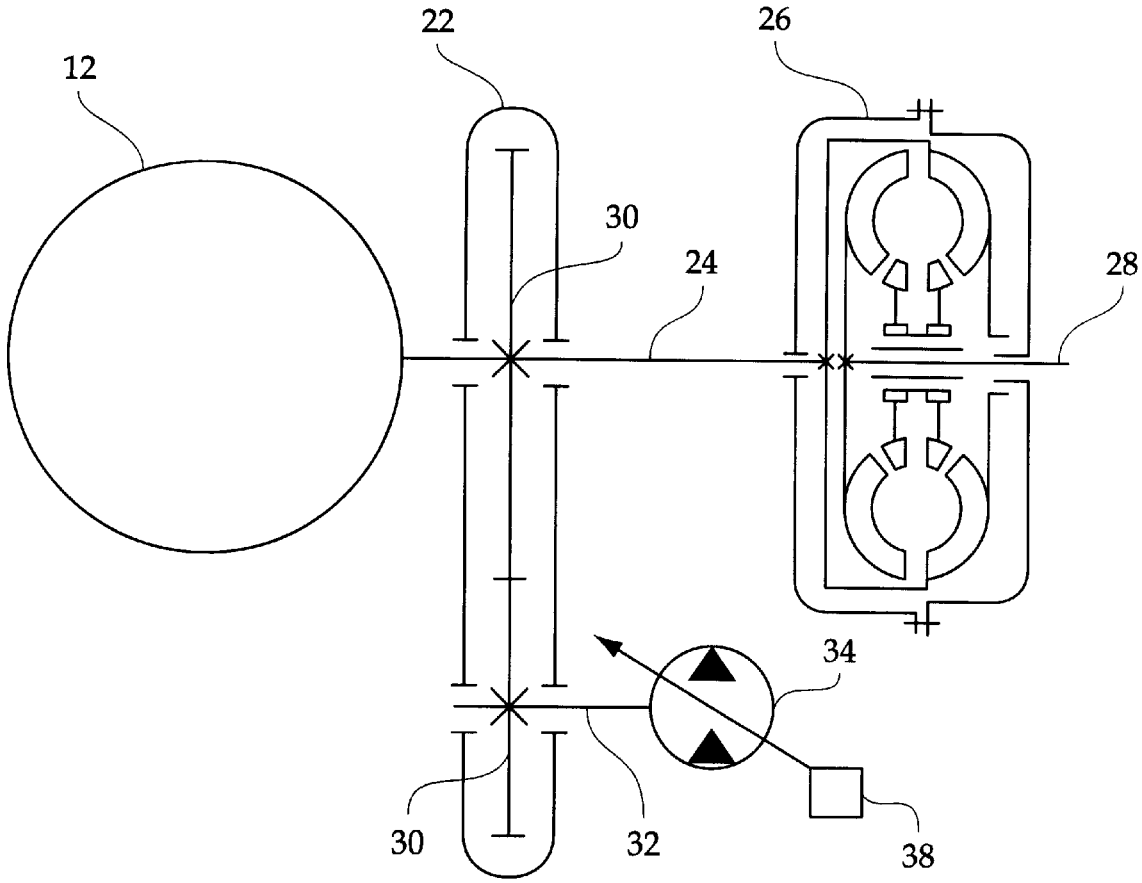
FIG. 2 is a kinematical diagram of the present invention.
Figure 3:
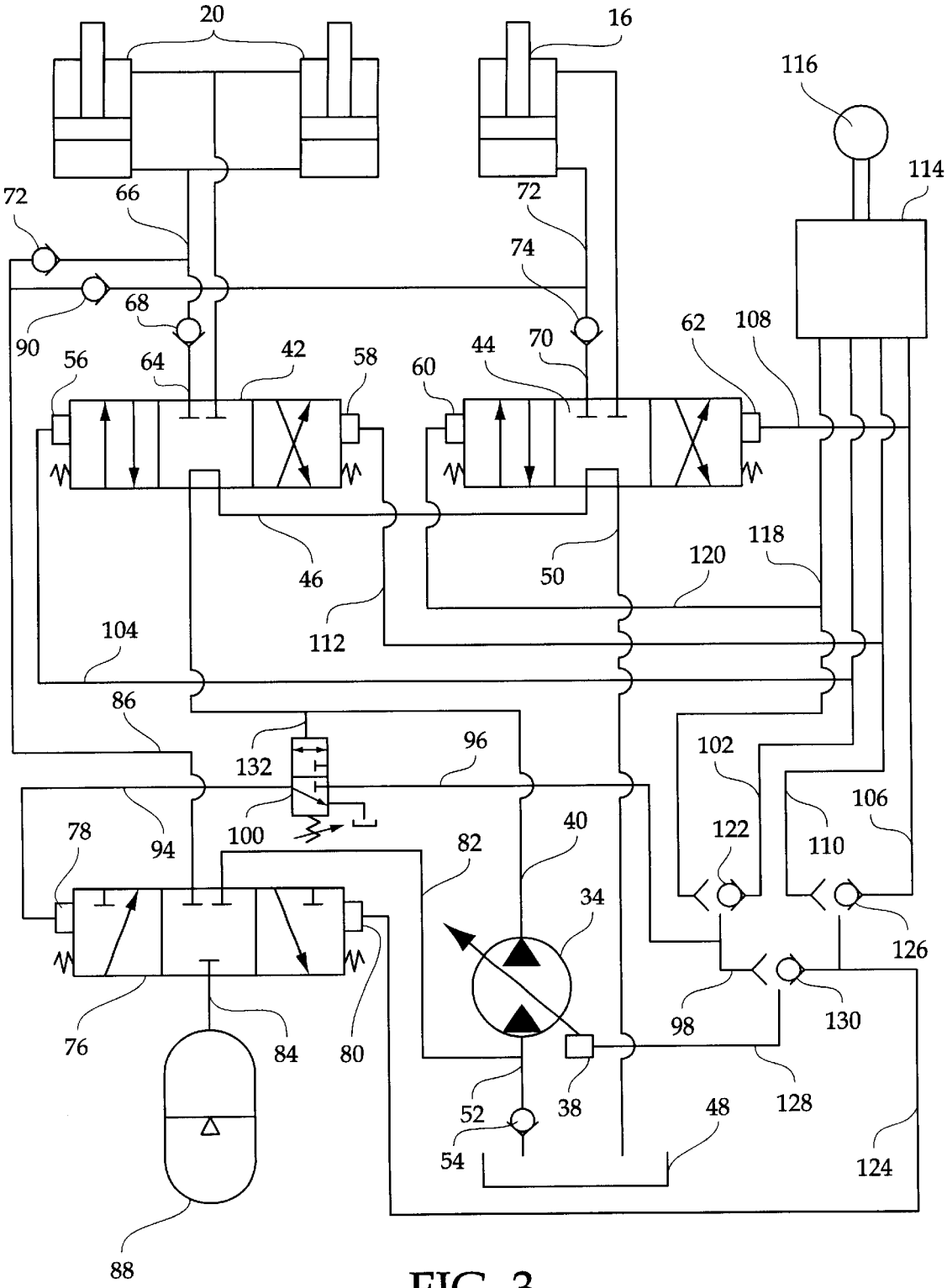
FIG. 3 is a hydraulic diagram of the present invention.

With reference now to the drawings, and in particular, to FIGS. 1 through 3 thereof, the preferred embodiment of the new and improved frontal loader embodying the principles and concepts of the present invention and generally designated by the reference number 10 will be described.

Specifically, it will be noted in the various Figures that the device relates to a frontal loader for providing increased efficiency while minimizing fuel consumption.

The present invention is comprised of a front loader 10 comprised of an engine 12, working equipment 13, a bucket 14 and a corresponding hydraulic cylinder 16, a boom 18 and a corresponding hydraulic cylinders 20. The engine 12 has a gear 22 connected thereto. The gear 22 has a first outlet shaft 24 coupled thereto. The front loader 10 includes a turbine transformer 26 coupled with the first outlet shaft 24 of the engine 12. The turbine transformer 26 has an outlet shaft 28 couplable to loader wheels by a gear box and driving axle. (Not illustrated) The gear 22 has a pair of gear wheels 30 coupled thereto. The gear 22 has a second outlet shaft 32. The working equipment 13 has a variable displacement pump-motor 34 having a hydraulic servo 38. The variable displacement pump-motor 34 has a shaft coupled with the second outlet shaft 32 of the gear 22. The displacement pumpmotor 34 is coupled with the hydraulic cylinders 20 boom lift via a first hydraulic line 40 to a distributor 42 of the boom lift. The distributor 42 has an outlet. The outlet is coupled with the distributor 44 of the bucket turn by a second hydraulic line 46. The distributor 44 has a discharge port coupled with a tank 48 by a third hydraulic line 50. A suction line 52 of the pump-motor 34 has a check valve 54 disposed therein. The distributor 42 of the boom lift has control chambers 56,58 for lifting and lowering. The distributor 44 of the bucket turn has control chambers 60,62 for excavating and unloading. The outlet for the distributor 42 of the boom lift has supply lines 64,66 and a check valve 68 coupled with cylinders 20. The outlet for the distributor 44 of the bucket turn has supply lines 70,72 and a check valve 74 coupled with the cylinder 16. A third hydraulic distributor 76 is supplied with a pair of control chambers 78,80. The suction line 52 of the pump motor 34 is coupled with the third hydraulic distributor 76 by a first hydraulic line 82. The third hydraulic distributor 76 has second and third hydraulic lines 84,86. The second hydraulic line 84 is coupled with a pneumohydraulic accumulator 88. The third hydraulic line 86 is coupled by two check valves 90,72 to the cylinder bucket turn 16 and the boom lift 20. One of the control chambers 78 of the third hydraulic distributor 76 is connected to the excavating control chamber 60 by lines 94,96, 98,118,120 and a two-position valve 100 and a first valve 122 and to the lifting control chamber 56 by two lines 102,104 and the first valve 122. The other control chamber 80 of the third hydraulic distributor 76 is connected with the unloading and lowering control chambers 62,58 by separate lines 124,106,108 and 110,112 and second valve 126. The two-position valve 100 has a control hydraulic line 132 coupled with the first hydraulic line 40.

A remote proportional control block 114 with a control crank 116 is coupled with the excavation control chamber 60 by a pair of lines 118,120 and with the unloading control chamber 62 by a pair of lines 106,108 and with the lowering control chamber 58 by a pair of lines 110,112 and with the lifting control chamber 56 by a pair of lines 102,104 and with the hydraulic servo 38 by lines 118,102,106,110,128 and valves 122,126,130.

In use, the engine works when its crankshaft's rotation is driven to the inlet shaft of the gear which transmits rotation to the outlet shaft of loader movement transmission by the first outlet shaft through the turbine transformer. The inlet shaft of the gear transmits rotation to the second outlet shaft and to the variable displacement pump motor of working equipment by the gear wheels.

When the crank of the control block is in a neutral position, there is no oil pressure in the hydraulic lines so the distributors are in the neutral position, and the variable displacement pump motor oil delivery takes place with minimum displacement volume in accordance with the engine crankshaft angular speed.

Thus, if the crank of the control block is in the neutral position, oil sucked by the hydraulic line by the variable displacement pump motor is discharged to the hydraulic distributor along the hydraulic line and then it goes to the tank along the other hydraulic line.

Describing the excavation process, the operator inclines crank 116 to the position "excavation". Control pressure goes along hydraulic lines 118,120 to the excavation control chamber 60 and via valve 122 along hydraulic lines 94,96 and valve 100 (pressure in hydraulic lines 40,132 in excavation process is enough to change valve 100 to the position connecting lines 96 with 94) to the control chamber 78 of the third hydraulic distributor 76 which switches to the position connecting the second hydraulic line 84 with the first hydraulic line 82. At the same time, oil from the pump motor 34 goes along lines 40,46,70,72 via distributor 44 and check valve 74 goes in rodless chamber and goes out to tank from rod chamber cylinder 16. This enables oil movement under pressure from PHA 88 to suction chamber of pump motor 34 which changes its mode of work to hydraulic motor transforming accumulated in PHA 88 energy to the work on the shaft of the hydraulic motor 34, which is transmitted along gear wheels 30 of gear 22 of movement transmission and which is added to the work of the engine 12. Thus, energy recuperation takes place and this additional energy goes irrespective of the type of transmission from the first outlet shaft 24 to loader wheels. Additional capacity from energy recuperation solves the problem to use more smaller capacity engine than a serial loader and same productivity in the most energy consuming operation—process of excavation without overloading this (smaller) engine with decrease of fuel consumption and volume of toxic exhaust.

In the process of excavation, the operator controls by crank 116, the volume of working of the variable displacement pump motor 34, which works in a motor mode, since oil pressure in the hydraulic servo 38 corresponds to the pressure in hydraulic lines 98,118,128, with the help of valves 122,130. This enables the changing of the bucket turn speed of the loader by displacement and without trotting control in the distributor 44 turns a bucket, which also decreases fuel consumption.

The process of lifting involves the following steps: After finishing the excavation process, the operator inclines the crank 116 to the "lift" position and control pressure goes along hydraulic lines 102,104 to chamber 56. The pump motor 34 delivers oil to rodless chambers of hydraulic cylinders 20 along hydraulic lines 40,64,66 via distributor 42 and check valve 68. From the rod chambers, oil goes to the tank 48. The hydraulic line 86, which is under pressure, is closed by the distributor 76, the PHA is connected with the suction line of the pump-motor 34, which changes its mode of work to that of the hydraulic motor. PHA transmits accumulated energy to the hydraulic motor 34 in such a way as when excavating. Additional capacity from energy recuperation solves the problem of using more smaller capacity engines than a serial loader of the same productivity in the most energy consuming operation of loaded bucket lifting, without overloading this engine with the decrease of fuel consumption and volume of toxic exhaust. Maximum incline of the crank 116 allows the lift loaded bucket on maximum displacement volume of pumpmotor 34, which works in motor mode.

Process of Unloading

After finishing the process of loaded bucket lifting for unloading of material from the bucket, operator inclines crank 116 to the unloading position. Control pressure goes along hydraulic lines 106,108 to chamber 62. Thus control pressure goes to chamber 80 via valve 126 and line 124 and to hydraulic servo 38 along hydraulic line 128 and valves 126 and 130. Pump-motor 34 delivers oil to rod chambers of hydraulic cylinder 16 and goes out from rodless chambers to PHA and is accumulated as potential energy of compressed gas. This PHA energy consists of power delivery to pump-motor 34 from engine and potential energy of material in bucket. Engine is loaded with additional power, necessary for pump-motor 34, in the least power consuming part of working cycle—unloading. Pump-motor 34 intakes oil through hydraulic line 52 and check valve 54 end work in pump-mode.

Process of Bucket Reset

After unloading, operator inclines crank 116 to the excavation position and similar to excavation control pressure goes to chamber 60. Control pressure does not go (pressure in hydraulic lines 40,132 during bucket reset is not enough to change valve 100 to connect lines 96 with 94 because bucket is empty) to chamber 78 of distributor 76. Distributor 76 is in the neutral position and accumulated energy in PHA from unloading is preserved during bucket reset. Pump-motor 34 intakes oil from tank and works in pump-mode.

Process of Lowering the Boom

For this purpose, operator inclines crank 116 to the lowering position and control pressure goes from hydraulic line 110, 112 to chamber 58 and via valve 126 along hydraulic line 124 to chamber 80 of distributor 76 and to hydraulic servo 38 via valve 130 and hydraulic line 128. Pump-motor 34 delivers oil to rod chambers of hydraulic cylinders 20 and goes out from rodless chambers to PHA. Thus, the whole oil volume, coming out from rodless chambers of hydraulic cylinders 20, goes to PHA and is accumulated as potential energy of compressed gas. This PHA energy consists of power delivery to pump-motor 34 from engine and potential energy of lifted working equipment, which is accumulated in PHA during the process of lowering the boom.

Thus engine is loaded with additional power, necessary for pump-motor 34, in the least power consuming parts of working cycle process of unloading and process of lowering the boom. Accumulated PHA energy is realized in the most power consuming parts of working cycle—excavation and lifting of loaded bucket. Due to this power delivery from the engine during working cycle, the loader becomes more uniform and that determines fuel saving mode of its work. Lowering the boom and approach to the place of excavation finish the working cycle of the loader.

Thus, the described working process allows use of a smaller capacity engine than an engine at serial loader with same productivity and a decrease of fuel consumption and volume of gar exhaust with one crank control distributors of working equipment and volume of its pump-motor without trotting in distributors to lift a boom and turn a bucket.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A frontal loader for providing increased efficiency while minimizing fuel consumption, comprising:

an engine connected to a gear, the gear having a first outlet shaft, a second outlet shaft and a pair of gear wheels coupled thereto;

a bucket with a corresponding bucket turn comprising a hydraulic cylinder;

a boom with a corresponding boom lift comprising a hydraulic cylinders;

a turbine transformer coupled with the first outlet shaft, the turbine transformer having an outlet shaft coupled to loader wheels by a gearbox and a driving axle;

working equipment including;

a variable displacement pump having: a hydraulic servo, a shaft coupled with the second outlet shaft of the gear, and a suction line with a check valve; the variable displacement pump coupled via a first hydraulic line to a boom lift distributor;

the boom lift distributor having an outlet coupled to the boom lift by supply lines and a check valve and coupled to a bucket turn distributor by a second hydraulic line, the boom lift distributor having a lifting and lowering control chamber;

the bucket turn distributor having a discharge port coupled with a tank by a third hydraulic line, the bucket turn distributor having an excavating and unloading control chamber, an outlet for the bucket turn distributor having supply lines and a check valve coupled with the bucket turn;

a hydraulic distributor having a first control chamber and a second control chamber, the suction line of the variable displacement pump being coupled by a first hydraulic distributor line to the hydraulic distributor, by a second hydraulic distributor line to a pneumo-hydraulic accumulator, and by a third hydraulic distributor line and two check valves to the bucket turn and boom lift;

the first control chamber of the hydraulic distributor being connected to the excavating and unloading control chamber of the bucket turn by separate hydraulic lines, a two position valve and a first valve, the two position valve coupled to the first hydraulic line by a control line;

the second control chamber of the hydraulic distributor being connected with the lifting and lowering control chamber of the boom lift by two separate lines and a second valve; and a remote proportional control block with a control crank coupled with the excavating and unloading control chamber of the bucket turn by a pair of lines, with the lifting and lowering control chamber of the boom lift by a pair of lines and with the hydraulic servo of the variable displacement pump by three valves.

* * * * *

UNITED STATES PATENT AND TRADEMARK OFFICE

CERTIFICATE OF CORRECTION

PATENT NO. : 6,434,864 B1
DATED : August 20, 2002
INVENTOR(S) : Grigoriy Epshteyn It is certified that error appears in the above-identified patent and that said Letters Patent is hereby corrected as shown below:

Column 7,
Line 17, the word "gar" should be -- gas --.

Column 7, lines 41 - 49 to Column 8, lines 1 - 47,
Claim 1 should read as follows:

--1. A frontal loader for providing increased efficiency while minimizing fuel consumption, comprising:

an engine connected to a gear, the gear having a first outlet shaft, a second outlet shaft and a pair of gear wheel coupled thereto;

a bucket with a corresponding bucket turn comprising a hydraulic cylinder;

a boom with a corresponding boom lift comprising [a] hydraulic cylinders;

a turbine transformer coupled with the first outlet shaft, the turbine transformer having an outlet shaft coupled to loader wheels by a gear box and a driving axle;

working equipment including[;]:

a variable displacement pump having: a hydraulic servo, a shaft coupled with the second outlet shaft of the gear, and a suction line with a check valve; the variable displacement pump coupled via a first hydraulic line to a boom lift distributor;

the boom lift distributor having an outlet coupled to the boom lift by supply lines and a check valve and coupled to a bucket turn distributor by a second hydraulic line, the boom lift distributor having a lifting and lowering control chamber;

the bucket turn distributor having a discharge port coupled with a tank by a third hydraulic line, the bucket turn distributor having an excavating and unloading control chamber, an outlet for the bucket turn distributor having supply lines and a

UNITED STATES PATENT AND TRADEMARK OFFICE

CERTIFICATE OF CORRECTION

PATENT NO. : 6,434,864 B1
DATED : August 20, 2002
INVENTOR(S) : Grigoriy Epshteyn It is certified that error appears in the above-identified patent and that said Letters Patent is hereby corrected as shown below:

check valve coupled with the bucket turn;

a hydraulic distributor having a first control chamber and a second control chamber, the suction line of the variable displacement pump being coupled by a first hydraulic distributor line to the hydraulic distributor, by a second hydraulic distributor line to a pneumohydraulic accumulator, and by a third hydraulic distributor line and two check valves to the bucket turn and boom lift;

the first control chamber of the hydraulic distributor being connected to the excavating and lifting [unloading] control chambers [chamber] of the bucket turn and boom lift by separate hydraulic lines, a two position valve and a first valve, the two position valve coupled to the first hydraulic line by a control line;

the second control chamber of the hydraulic distributor being connected with the unloading [lifting] and lowering control chambers [chamber] of the bucket turn and boom lift by two separate lines and a second valve; and a remote proportional control block with a control crank coupled with the excavating and unloading control chamber of the bucket turn by a pair of lines, with the lifting and lowering control chamber of the boom lift by a pair of lines and with the hydraulic servo of the variable displacement pump by three valves.--

Signed and Sealed this

Twenty-eighth Day of January, 2003

JAMES E. ROGAN
*Director of the United States Patent and Trademark Office*